US009865161B2

(12) United States Patent
Zhang et al.

(10) Patent No.: US 9,865,161 B2
(45) Date of Patent: Jan. 9, 2018

(54) METHOD, REMOTE CONTROLLER AND ELECTRICAL APPLICANCE FOR RELEASING A BINDING OF A REMOTE CONTROLLER

(71) Applicant: Xiaomi Inc., Haidian District, Beijing (CN)

(72) Inventors: Yanlu Zhang, Beijing (CN); Deguo Meng, Beijing (CN); Enxing Hou, Beijing (CN)

(73) Assignee: XIAOMI INC., Haidian District, Beijing (CN)

( * ) Notice: Subject to any disclaimer, the term of this patent is extended or adjusted under 35 U.S.C. 154(b) by 0 days.

(21) Appl. No.: 15/373,476

(22) Filed: Dec. 9, 2016

(65) Prior Publication Data

US 2017/0178494 A1 Jun. 22, 2017

(30) Foreign Application Priority Data

Dec. 18, 2015 (CN) ..... 2015 1 0958763

(51) Int. Cl.
*G08C 17/02* (2006.01)

(52) U.S. Cl.
CPC ..... *G08C 17/02* (2013.01); *G08C 2201/20* (2013.01); *G08C 2201/50* (2013.01); *G08C 2201/91* (2013.01); *G08C 2201/92* (2013.01)

(58) Field of Classification Search
CPC ..... G08C 17/02; G08C 2201/20; G08C 2201/50; G08C 2201/70; G08C 2201/93
See application file for complete search history.

(56) References Cited

U.S. PATENT DOCUMENTS

2006/0103545 A1* 5/2006 Tsou ..... G08C 17/02 340/12.29
2010/0013609 A1* 1/2010 Symoen ..... G08C 17/02 340/12.32

(Continued)

FOREIGN PATENT DOCUMENTS

CN 103914041 A 7/2014
CN 103941667 A 7/2014

(Continued)

OTHER PUBLICATIONS

International Search Report of PCT/CN2016/096656.
Extended European Search Report of European Application No. 16203408.6 dated May 9, 2017.

*Primary Examiner* — Thomas Alunkal
(74) *Attorney, Agent, or Firm* — Jun He Law Offices P.C.; James J. Zhu

(57) ABSTRACT

A method, a remote controller and an electrical appliance for releasing a binding of a remote controller are provided. The method includes: acquiring, by the remote controller, a trigger event for releasing a binding; broadcasting, by the remote controller, a request to release the binding based on the trigger event for releasing the binding; judging, by an electrical appliance, whether a binding relationship between the electrical appliance and the remote controller needs to be released based on the request to release the binding; and releasing the binding relationship between the electrical appliance and the remote controller upon the judgment that the binding relationship between the electrical appliance and the remote controller needs to be released.

8 Claims, 5 Drawing Sheets

(56) References Cited

U.S. PATENT DOCUMENTS

| | | | | |
|---|---|---|---|---|
| 2014/0097934 | A1* | 4/2014 | Su | G08C 17/00 340/3.1 |
| 2015/0126126 | A1* | 5/2015 | Lee | H04L 12/2816 455/41.3 |
| 2015/0305551 | A1* | 10/2015 | Rosati | A23F 3/18 426/231 |
| 2016/0179068 | A1* | 6/2016 | Qian | G05B 15/02 700/275 |

FOREIGN PATENT DOCUMENTS

| | | | |
|---|---|---|---|
| CN | 104767756 | A | 7/2015 |
| CN | 105610905 | A | 5/2016 |
| EP | 2479735 | A2 | 7/2012 |

* cited by examiner

METHOD, REMOTE CONTROLLER AND ELECTRICAL APPLICANCE FOR RELEASING A BINDING OF A REMOTE CONTROLLER

CROSS REFERENCE TO RELATED APPLICATION

This application bases on and claims priority to Chinese Patent Application No. 201510958763.1, filed Dec. 18, 2015, which is incorporated herein by reference in its entirety.

TECHNICAL FIELD

The present disclosure relates to communication technology, and more particularly, to a method, a remote controller and an electrical appliance for releasing a binding of a remote controller.

BACKGROUND

With an increase of electrical appliances in a user's home, the number of remote controllers (including infrared remote controller, Bluetooth remote controller) for controlling these electrical appliances increases accordingly. Typically, the user may need spending much time to find a currently required remote controller, because some of the remote controllers have similar appearance such that it is laborious for the user to make a determination. In view of this, a "universal remote controller" that can be bound with multiple electrical appliances by using infrared, Bluetooth technologies or the like emerged, and thus can control operations of the multiple electrical appliances.

Typically, after a remote controller has been bound with multiple electrical appliances, a user can also release a binding (bindings) of the remote controller with one or more of the multiple electrical appliances. Therefore, the remote controller is able to be used with a flexible range of uses and a flexible number of controlled objects.

SUMMARY

In view of the fact in related arts, the present disclosure provides a method, a remote controller and an electrical for releasing a binding of a remote controller.

According to a first aspect of embodiments in the present disclosure, a method for releasing a binding of a remote controller is provided. The method may include: acquiring, by the remote controller, a trigger event for releasing a binding; broadcasting, by the remote controller, a request to release the binding based on the trigger event for releasing the binding; judging, by an electrical appliance, whether a binding relationship between the electrical appliance and the remote controller needs to be released based on the request to release the binding; and releasing the binding relationship between the electrical appliance and the remote controller upon the judgment that the binding relationship between the electrical appliance and the remote controller needs to be released.

According to a second aspect of embodiments in the present disclosure, a remote controller is provided. The remote controller includes a communication component, a processor and a memory for storing executable instructions by the processor, wherein the processor is configured to perform the executable instructions to acquire a trigger event for releasing a binding and broadcast a request to release the binding based on the trigger event for releasing the binding.

According to a third aspect of embodiments in the present disclosure, an electrical appliance is provided. The electrical appliance includes a communication component, a processor, and a memory for storing executable instructions by the processor, wherein the processor is configured to perform the executable instructions to judge whether a binding relationship between the electrical appliance and a remote controller needs to be released based on a request to release a binding and release the binding relationship between the electrical appliance and the remote controller upon the judgment that the binding relationship between the electrical appliance and the remote controller is needs to be released. It is to be understood that both the forgoing general descriptions and the following detailed descriptions are exemplary and explanatory only, and are not restrictive of the present disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which same numbers in different drawings represent same or similar elements unless otherwise described. The implementations set forth in the following description of exemplary embodiments do not represent all implementations consistent with the disclosure. Instead, they are merely examples of devices and methods consistent with aspects related to the disclosure as recited in the appended claims.

Figure 1:
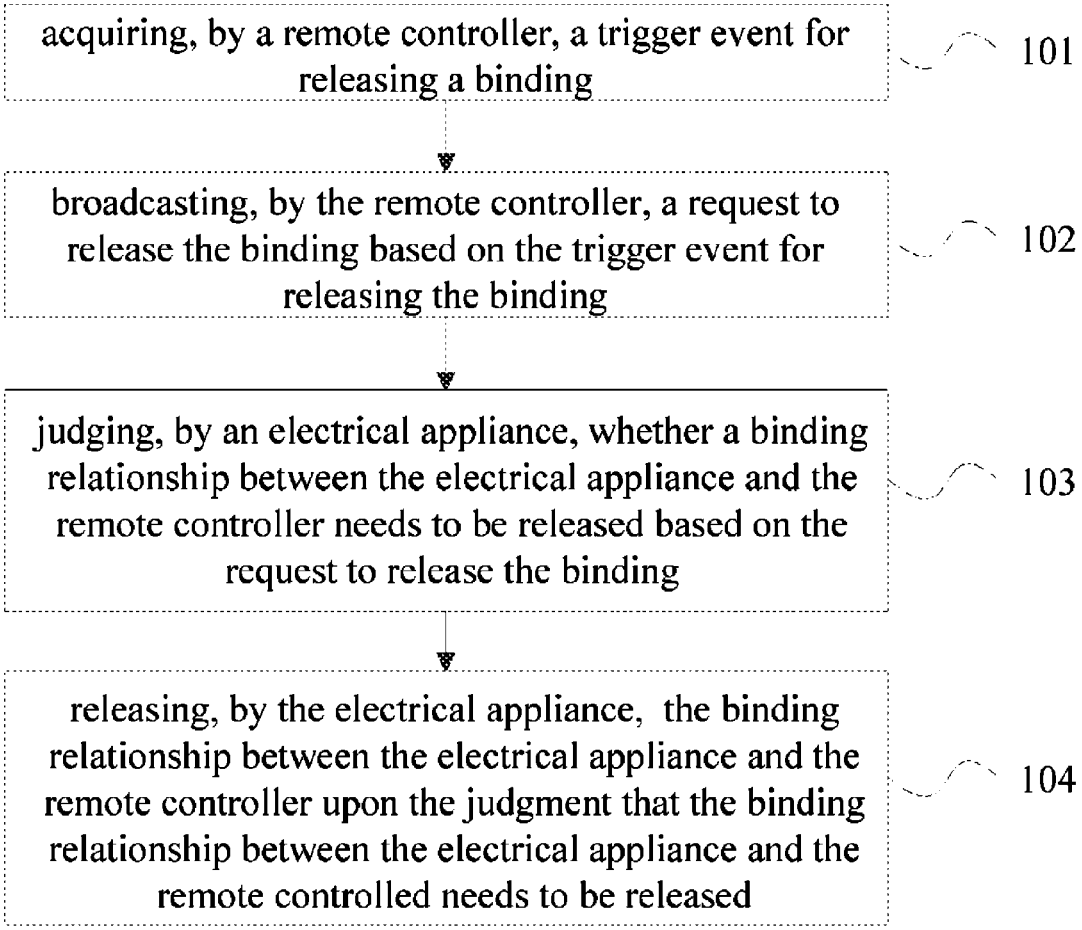
FIG. 1 is a flow chart illustrating a method for releasing a binding of a remote controller according to an exemplary embodiment.

FIG. 1 is a flow chart illustrating a method for releasing a binding of a remote controller according to an exemplary embodiment. As shown in FIG. 1, the method for releasing a binding of a remote controller includes the following steps.

In step 101, the remote controller acquires a trigger event for releasing a binding.

Typically, a remote controller can be bound with multiple electrical appliances by using infrared, Bluetooth technologies or the like such that a user can operate multiple electrical appliances with a single remote controller. After the remote controller are bounded with multiple electrical appliances, the user can also release a binding (bindings) of the remote controller with one or more of the multiple electrical appliances. Therefore, the remote controller is able to be used with a flexible range of uses and a flexible number of controlled objects. Generally, a binding release operation is implemented by adjusting a distance between the remote controller and an electrical appliance such that it falls within a certain range, pressing particular buttons on the remote controller and the electrical appliance at the same time such that an interaction for binding release is made by using infrared, Bluetooth technologies or the like and finally releasing the binding relationship therebetween. However, certain electrical appliances do not have their own buttons and thus it is impossible for them to release a binding relationship between the electrical appliance and the remote controller by utilizing the above discussed methods.

In the present disclosure, when a user wants to release a binding relationship between a remote controller and an electrical appliance, he/she approaches the remote controller to the electrical appliance, and presses a preset button on the remote controller, which triggers an event for release a binding. The remote controller may acquire the trigger event for releasing the binding by sensing such press operation on the button.

In step 102, the remote controller broadcasts a request to release the binding based on the trigger event for releasing the binding.

Based on occurrence of the trigger event for releasing the binding, the remote controller broadcasts a request to release the binding around. The request to release the binding may include a Media Access Control (simply referred to as MAC) address of the remote controller. The remote control may broadcast the request to release the binding by its own communication function such as infrared, Bluetooth or the like.

In step 103, an electrical appliance judges whether a binding relationship between the electrical appliance and the remote controller needs to be released based on the request to release the binding.

Since the remote controller sends out the request to release the binding by broadcast, it is possible that multiple electrical appliances within the communication range may receive the request to release the binding. An electrical appliance needs to judge whether its binding relationship with the remote controller needs to be released. Otherwise, all of the electrical appliances that have received the request to release the binding will release their respective bindings with the remote controller, which may cause error unbinding.

In step 104, the electrical appliance releases the binding relationship between the electrical appliance and the remote controller upon the judgment that the binding relationship between the electrical appliance and the remote controller needs to be released.

When the electrical appliance judges that its binding relationship with the remote controller needs to be released, it releases the binding relationship with the remote controller such that the remote controller cannot control the electrical appliance anymore and thereby the user cannot operate the electrical appliance by using the remote controller.

In the present embodiment, the remote controller alone can send out a request to release a binding with an electrical appliance, and the electrical appliance judges whether its binding relationship with the remote controller needs to be released upon reception of the request to release the binding and finally releases the binding relationship with the remote controller. Accordingly, an operation for releasing a binding between a remote controller and an electrical appliance can be simplified. Also, error unbinding caused if all of electrical appliances that receive a request to release a binding release their respective bindings with the remote controller can be avoided. Therefore, user experience can be improved.

Figure 2:
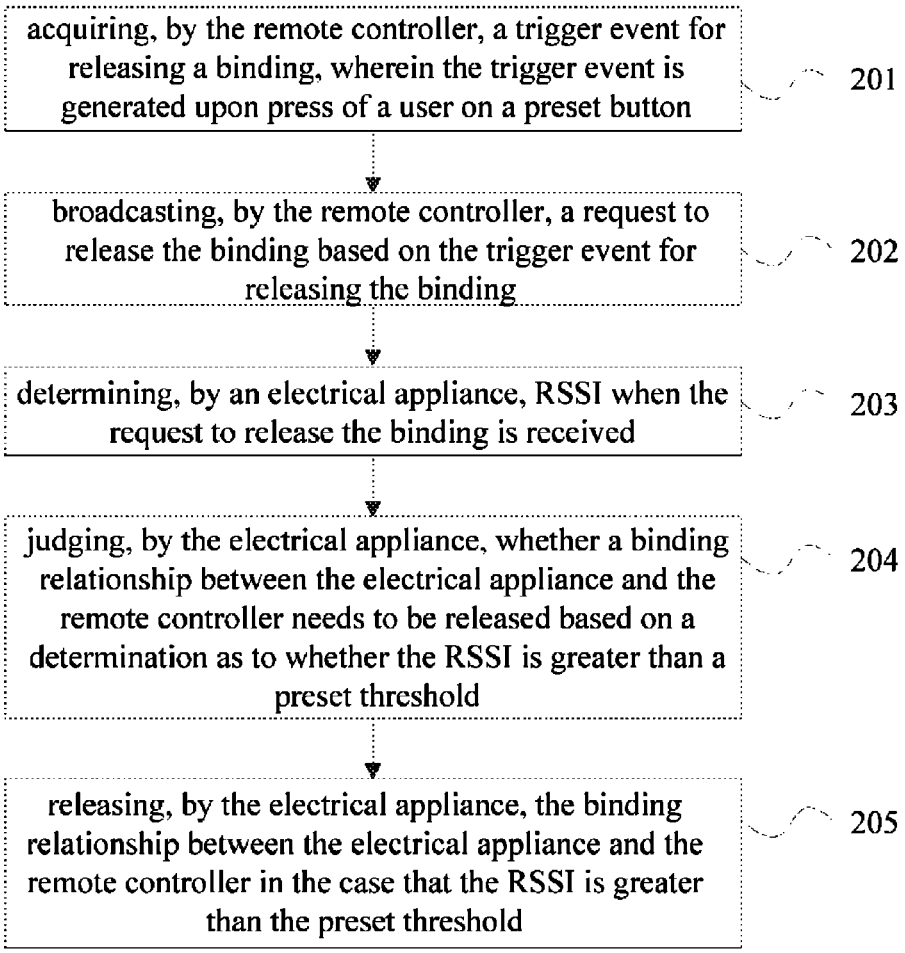
FIG. 2 is a flow chart illustrating a method for releasing a binding of a remote controller according to an exemplary embodiment.

FIG. 2 is a flow chart illustrating a method for releasing a binding of a remote controller according to an exemplary embodiment. As shown in FIG. 2, the method for releasing a binding of a remote controller may include the following steps.

In step 201, the remote controller acquires a trigger event for releasing a binding and the trigger event for releasing a binding is generated upon press of a user on a preset button.

In the present embodiment, when a user wants to release a binding relationship between a remote controller and an electrical appliance, he/she approaches the remote controller to the electrical appliance, and presses a preset button on the remote controller, which triggers an event for release a binding. The press of a preset button may be implemented by the user pressing two particular buttons on the remote controller at the same time, or by the user pressing a binding-release specific button on the remote controller. The remote controller may acquire the trigger event for releasing the binding by sensing such press operation on the button(s). Since the remote controller alone can send out the request to release the binding, an operation for releasing a binding between a remote controller and an electrical appliance can be simplified.

In step 202, the remote controller broadcasts a request to request the binding based on the trigger event for releasing the binding.

This step is similar with the above step 102 and thus is not repeatedly described.

In step 203, an electrical appliance determines RSSI when the request of releasing the binding is received.

After reception of the request of releasing the binding, the electrical appliance determines a Received Signal Strength Indication (also referred to as RSSI) when the request of releasing the binding is received.

In step 204, the electrical appliance judges whether the binding relationship between the electrical appliance and the remote controller needs to be released based on a determination as to whether the RSSI is greater than a preset threshold.

The electrical appliance judges whether the binding relationship between the electrical appliance and the remote controller needs to be released based on a determination as to whether the RSSI is greater than a preset threshold. When the RSSI exceeds the preset threshold, it means that the remote controller is sufficiently close to the electrical appliance, and that the user is using the remote controller to remove a binding of the electrical appliance. So, the electrical appliance determines that the request to release the binding just is sent to the electrical appliance itself and it should release its binding relationship with the remote controller. The electrical appliance, after reception of the request to release the binding, can accurately determines whether the request to release the binding sent from the remote controller is directed to the electrical appliance itself according to the RSSI in order to finally release its binding relationship with the remote controller. Thus, error unbinding caused if all of electrical appliances that receive a request to release a binding release their respective bindings with the remote controller can be avoided, and thereby user experience can be improved.

In step 205, if the electrical appliance determines that the RSSI is greater than the preset threshold, the electrical appliance releases its binding relationship with the remote controller.

As above described, the electrical appliance releases its binding relationship with the remote controller in the case that the RSSI is greater than the preset threshold.

In the embodiment, the remote controller alone can send out a request to request a binding with an electrical appliance, and the electrical appliance judges whether its binding relationship with the remote controller needs to be released upon reception of the request to release the binding and finally releases the binding relationship with the remote controller. Accordingly, an operation for releasing a binding between a remote controller and an electrical appliance can be simplified. Also, error unbinding caused if all of electrical appliances that receive a request to request a binding release their respective bindings with the remote controller can be avoid. Thereby user experience can be improved.

Figure 3:
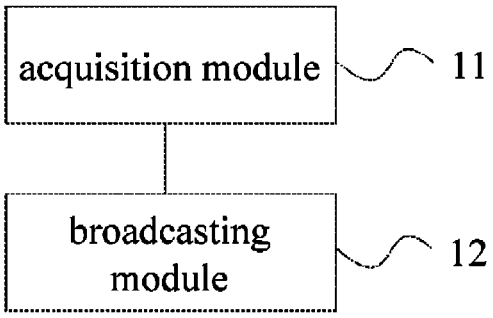
FIG. 3 is a block diagram illustrating a remote control device according to an exemplary embodiment.

FIG. 3 is a block diagram illustrating a remote control device according to an exemplary embodiment. As shown in FIG. 3, the remote control device includes an acquisition module 11 and a broadcasting module 12.

The acquisition module 11 is configured to acquire a trigger event for releasing a binding.

The broadcasting module 12 is configured to broadcast a request to request the binding based on the trigger event for releasing the binding.

The implementation procedures of functions and features of respective modules of the device are same as those in respective steps of the above methods, and thus will be not repeated here.

Optionally or alternatively, the acquisition module 11 may be configured to acquire the trigger event for releasing the binding and the trigger event for releasing the binding is generated upon press of a user on a preset button.

Optionally or alternatively, the request to release the binding may include a Media Access Control (MAC) address of the remote controller.

Figure 4:
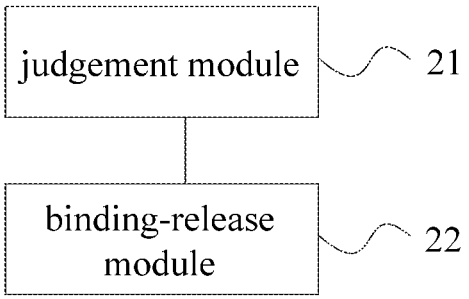
FIG. 4 is a block diagram illustrating an electrical device according to an exemplary embodiment.

FIG. 4 is a block diagram illustrating an electrical device according to an exemplary embodiment. As shown in FIG. 4, the device includes a judgment module 21 and a binding-release module 22.

The judgment module 21 is configured to judge, based on the request to release the binding, whether a binding relationship between the electrical device and the remote control device needs to be released.

The binding-release module 22 is configured to release the binding relationship between the electrical appliance and the remote control device upon the judgment that the binding relationship between the electrical device and the remote control device needs to be released.

The implementation procedures of functions and features of respective modules of the device are same as those in respective steps of the above methods, and thus will be not repeated here.

Figure 5:
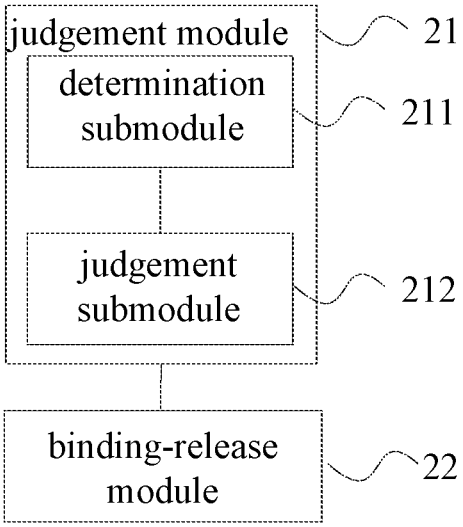
FIG. 5 is a block diagram illustrating an electrical device according to an exemplary embodiment.

FIG. 5 is a block diagram illustrating an electrical device according to an exemplary embodiment. As shown in FIG. 5, the device has its structure based on that shown in the block diagram of FIG. 4. The judgment module 21 includes: a determination submodule 211 and a judgment submodule 212.

The determination submodule 211 is configured to determine a received signal strength indication RSSI upon reception of the request to release the binding.

The judgment submodule 212 is configured to judge whether the binding relationship between the electrical device and the remote control device needs to be released based on a determination as to whether the RSSI is greater than a preset threshold.

The implementation procedures of functions and features of respective modules of the device are same as those in respective steps of the above methods, and thus will be not repeated here.

Optionally or alternatively, the binding-release module 22 is configured to release the binding relationship between the electrical device and the remote control device upon determination that the RSSI is greater than the preset threshold.

Figure 6:
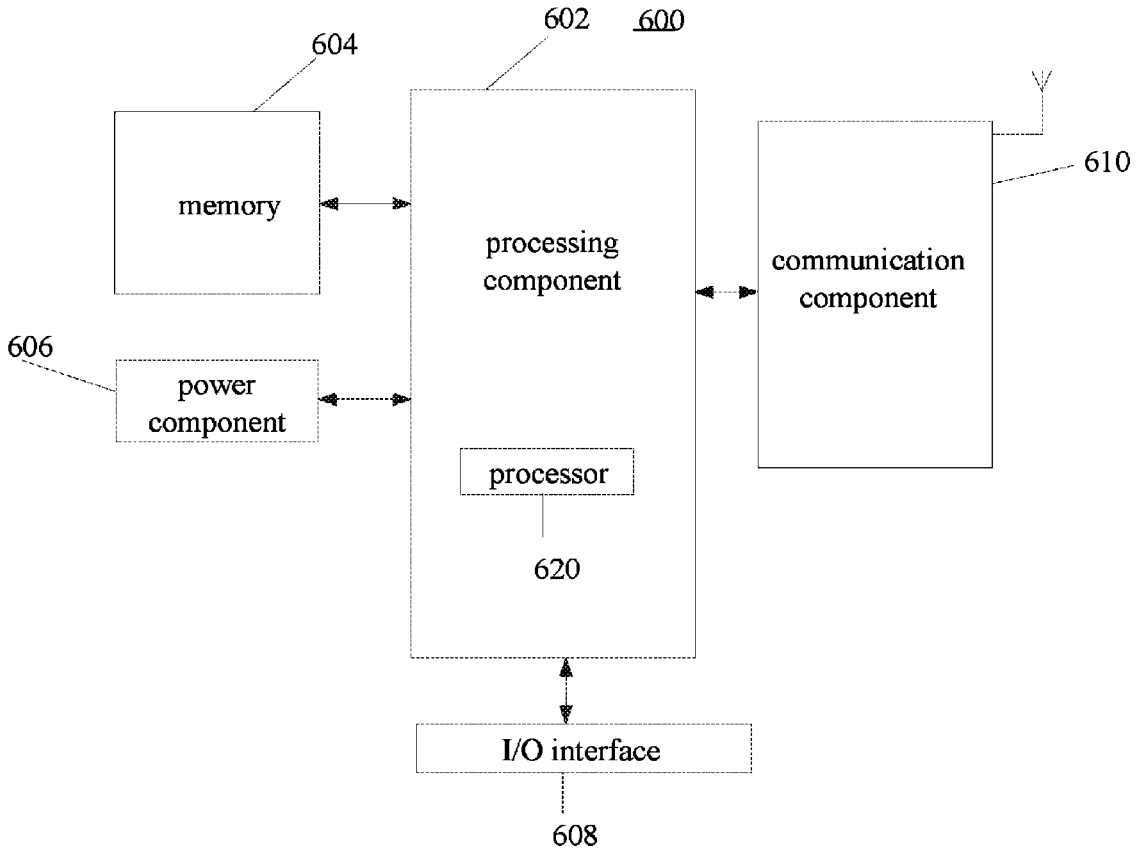
FIG. 6 is a block diagram illustrating a remote controller according to an exemplary embodiment.

FIG. 6 is a block diagram illustrating a remote controller according to an exemplary embodiment. As shown in FIG. 6, the remote controller 600 may include one or more of the following components: a processing component 602, a memory 604, a power component 606, an input/output (also referred to as I/O) interface 608 and a communication component 610.

The processing component 602 typically controls overall operations of the remote controller 600, such as the operations associated with display, telephone calls, data communications, camera operations, and recording operations. The processing component 602 may include one or more processors 620 to execute instructions to perform all or part of the steps in the above described methods. Moreover, the processing component 602 may include one or more modules which facilitate the interaction between the processing component 602 and other components.

The memory 604 is configured to store various types of data to support the operation of the remote controller 600. Examples of such data may include instructions for any applications or methods operated on the remote controller 600. The memory 604 may be implemented using any type of volatile or non-volatile memory devices, or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, a magnetic or optical disk.

The power component 606 provides power to various components of the remote controller 600. The power component 606 may include a power management system, a power sources, and any other components associated with the generation, management, and distribution of power in the remote controller 600.

The I/O interface 608 provides an interface between the processing component 602 and peripheral interface modules, such as a keyboard, a click wheel, buttons, and the like. The buttons may include, but are not limited to, a home button, a volume button, a starting button, and a locking button.

The communication component 610 is configured to facilitate communication, wired or wirelessly, between the remote controller 600 and other devices. The remote controller 600 can access a wireless network based on a communication standard, such as WiFi, 2G, or 3G, or a combination thereof. In an exemplary embodiment, the communication component 610 receives a broadcast signal or broadcast associated information from an external broadcast management system via a broadcast channel. In an exemplary embodiment, the communication component 610 further includes a Near Field Communication (NFC) module to facilitate short-range communications. For example, the NFC module may be implemented based on a Radio Frequency Identification (RFID) technology, an Infrared Data Association (IrDA) technology, an Ultra-Wideband (UWB) technology, a Bluetooth (BT) technology, and other technologies.

In exemplary embodiments, the remote controller 600 may be implemented with an Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors, or other electronic components, for performing the above described methods.

In exemplary embodiments, there is also provided a non-transitory computer-readable storage medium including instruction, such as the memory 604 including instructions executable by the processor 620 in the remote controller 600 to perform the above-described methods. For example, the non-transitory computer-readable storage medium may be a Read-Only Memory (ROM), a Random Access Memory (RAM), a (Compact Disc Read-Only Memory) CD-ROM, a magnetic tape, a floppy disc, an optical data storage device, and the like.

A non-transitory computer readable storage medium including instructions, which when executed by a processor in a remote controller, cause the remote controller to perform a method for releasing a binding of the remote controller, the method comprises: acquiring a trigger event for releasing a binding; and broadcasting a request to release the binding based on the trigger event for releasing the binding.

Figure 7:
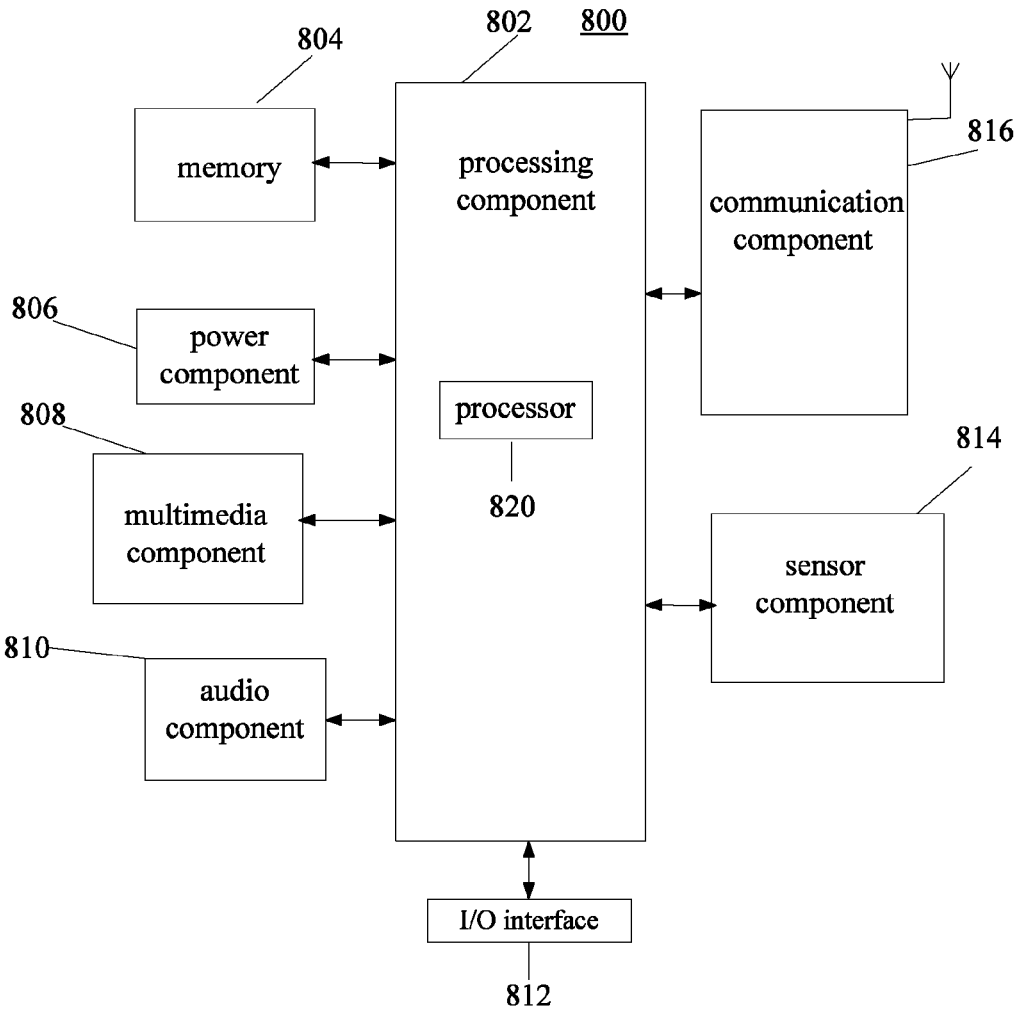
FIG. 7 is a block diagram illustrating an electrical appliance according to an exemplary embodiment.

FIG. 7 is a block diagram illustrating an electrical appliance according to exemplary embodiments. The electrical appliance 800 may be any kind of household electrical device, such as an air conditioner, a TV, a lamp, a robot cleaner, or the like.

As shown in FIG. 7, the electrical appliance 800 may include any of the following components: a processing component 802, a memory 804, a power component 806, a multimedia component 808, an audio component 810, an input/output (I/O) interface 812, a sensor component 814, and a communication component 816.

The processing component 802 typically controls overall operations of the electrical appliance 800, such as the operations associated with display, telephone calls, data communications, camera operations, and recording operations. The processing component 802 may include one or more processors 820 to execute instructions to perform all or part of the steps in the above described methods. Moreover, the processing component 802 may include any modules which facilitate the interaction between the processing component 802 and other components. For instance, the processing component 802 may include a multimedia module to facilitate the interaction between the multimedia component 808 and the processing component 802.

The memory 804 is configured to store various types of data to support the operation of the electrical appliance 800. Examples of such data may include instructions for any applications or methods operated on the electrical appliance 800, contact data, phonebook data, messages, pictures, video, etc. The memory 804 may be implemented using any type of volatile or non-volatile memory devices, or a combination thereof, such as a Static Random Access Memory (SRAM), an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, a magnetic or optical disk.

The power component 806 provides power to various components of the electrical appliance 800. The power component 806 may include a power management system, one or more power sources, and any other components associated with the generation, management, and distribution of power in the electrical appliance 800.

The multimedia component 808 includes a screen providing an output interface between the electrical appliance 800 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also detect a period of time and a pressure associated with the touch or swipe action. In some embodiments, the multimedia component 808 includes a front camera and/or a rear camera. The front camera and/or the rear camera may receive an external multimedia datum while the electrical appliance 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone ("MIC") configured to receive an external audio signal when the electrical appliance 800 is in an operation mode, such as a call mode, a recording mode, and a voice recognition mode. The received audio signal may be further stored in the memory 804 or transmitted via the communication component 816. In some embodiments, the audio component 810 further includes a speaker to output audio signals.

The I/O interface 812 provides an interface between the processing component 802 and peripheral interface modules, such as a keyboard, a click wheel, buttons, and the like. The buttons may include, but are not limited to, a home button, a volume button, a starting button, and a locking button.

The sensor component 814 includes one or more sensors to provide status assessments of various aspects of the electrical appliance 800. For instance, the sensor component 814 may detect an open/closed status of the electrical appliance 800, relative positioning of components, e.g., the display and the keypad, of the electrical appliance 800, a change in position of the electrical appliance 800 or a component of the electrical appliance 800, a presence or absence of user contact with the electrical appliance 800, an orientation or an acceleration/deceleration of the electrical appliance 800, and a change in temperature of the electrical appliance 800. The sensor component 814 may include a proximity sensor configured to detect the presence of nearby objects without any physical contact. The sensor component 814 may also include a light sensor, such as a Complementary Metal Oxide Semiconductor (CMOS) or Charge-coupled Device (CCD) image sensor, for use in imaging applications. In some embodiments, the sensor component 814 may also include an accelerometer sensor, a gyroscope sensor, a magnetic sensor, a distance sensor, a pressure sensor, or a temperature sensor.

The communication component 816 is configured to facilitate communication, wired or wirelessly, between the electrical appliance 800 and other devices. The electrical appliance 800 can access a wireless network based on a communication standard, such as WiFi, 2G, or 3G, or a combination thereof. In an exemplary embodiment, the communication component 816 receives a broadcast signal or broadcast associated information from an external broadcast management system via a broadcast channel. In an exemplary embodiment, the communication component 816 further includes a Near Field Communication (NFC) module to facilitate short-range communications. For example, the NFC module may be implemented based on a Radio Frequency Identification (RFID) technology, an Infrared Data Association (IrDA) technology, an Ultra-Wideband (UWB) technology, a Bluetooth (BT) technology, and other technologies.

In exemplary embodiments, the electrical appliance 800 may be implemented with Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors, or other electronic elements, for performing the above described methods.

In exemplary embodiments, there is also provided a non-transitory computer-readable storage medium including instructions, such as the memory 804 including instructions executable by the processor 820 in the electrical appliance 800 to perform the above-described methods. For example, the non-transitory computer-readable storage medium may be a Random Only Memory (ROM), a Random Access Memory (RAM), a Compact Disc Read-Only Memory (CD-ROM), a magnetic tape, a floppy disc, an optical data storage device, and the like.

A non-transitory computer readable storage medium including instructions, which when executed by a processor in an electrical appliance, cause the electrical appliance to perform a method for releasing a binding of the remote controller, the method comprises: judging, based on a request to release a binding, whether a binding relationship between the electrical appliance and the remote control device needs to be released; and releasing the binding relationship between the electrical device and the remote control device upon determination that the binding relationship between the electrical device and the remote control device needs to be released.

Figure 8:
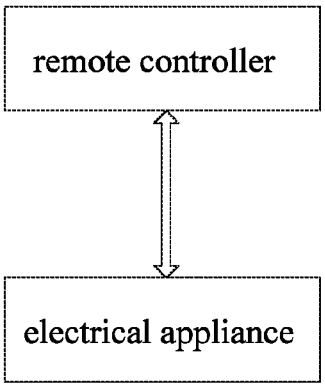
FIG. 8 is a block diagram illustrating a system for releasing a binding of a remote controller according to an exemplary embodiment.

FIG. 8 is a block diagram illustrating a system for releasing a binding of a remote controller according to an exemplary embodiment. As shown in FIG. 8, the system for releasing a binding of a remote controller includes: a remote controller according to the block diagram of FIG. 6 and an electrical appliance according to the block diagram of FIG. 7.

Other embodiments of the invention will be apparent to those skilled in the art from consideration of the specification and practice of the invention disclosed here. This application is intended to cover any variations, uses, or adaptations of the disclosure following general principles thereof and including such departures from the present disclosure as come within known or customary practice in the art. The specification and embodiments are merely considered to be exemplary and the substantive scope and spirit of the disclosure is limited only by the appended claims.

It should be understood that the disclosure is not limited to the precise structure as described above and shown in the figures, but can have various modification and alternations without departing from the scope of the disclosure. The scope of the disclosure is limited only by the appended claims.

What is claimed is:

1. A method for releasing a binding of a remote controller, comprising:

acquiring, by the remote controller, a trigger event for releasing a binding;

broadcasting, by the remote controller, a request to release the binding based on the trigger event for releasing the binding;

judging, by an electrical appliance, whether a binding relationship between the electrical appliance and the remote controller needs to be released based on the request to release the binding; and releasing the binding relationship between the electrical appliance and the remote controller upon the judgment that the binding relationship between the electrical appliance and the remote controller needs to be released, wherein judging, by the electrical appliance, whether the binding relationship between the electrical appliance and the remote controller needs to be released based on the request to release the binding comprises:

determining, by the electrical appliance, a received signal strength indication RSSI of the received request when the request to release the binding is received; and judging, by the electrical appliance, whether the binding relationship between the electrical appliance and the remote controller needs to be released based on a determination as to whether the RSSI is greater than a preset threshold.

2. The method of claim 1, wherein the trigger event for releasing the binding is generated upon press of a user on a preset button.

3. The method of claim 1, wherein releasing the binding relationship between the electrical appliance and the remote controller upon the judgment that the binding relationship between the electrical appliance and the remote controller needs to be released comprises:

releasing the binding relationship between the electrical appliance and the remote controller in the case that the RSSI is greater than the preset threshold.

4. The method of claim 1, wherein the request to release the binding comprises a Media Access Control (MAC) address of the remote controller.

5. The method of claim 2, wherein the request to release the binding comprises a Media Access Control (MAC) address of the remote controller.

6. The method of claim 3, wherein the request to release the binding comprises a Media Access Control (MAC) address of the remote controller.

7. An electrical appliance, comprises: a communication component, a processor and a memory for storing executable instructions by the processor, wherein the processor is configured to perform the executable instructions to judge whether a binding relationship between the electrical appliance and a remote controller needs to be released based on a request to release a binding; and release the binding relationship between the electrical appliance and the remote controller upon the judgment that the binding relationship between the electrical appliance and the remote controller needs to be released, wherein the processor is configured to:

determine a received signal strength indication RSSI of the received request when the request to release the binding is received; and judge whether the binding relationship between the electrical device and the remote control device needs to be released based on a determination as to whether the RSSI is greater than a preset threshold.

8. The electrical device of claim 7, wherein the processor is configured to release the binding relationship between the electrical device and the remote control device in the case that the RSSI is greater than the preset threshold.

* * * * *